United States Patent [19]

Kempf

[11] 4,232,613

[45] Nov. 11, 1980

[54] ARMOR PLATED SAFE

[75] Inventor: Alfons Kempf, Nikolsburger Strasse, D-8950 Kaufbeuren, Fed. Rep. of Germany

[73] Assignees: Adolf Frentrup, Kleve-Bedburg; Alfons Kempf, Kaufbeuren, both of Fed. Rep. of Germany

[21] Appl. No.: 9,836

[22] Filed: Feb. 6, 1979

[30] Foreign Application Priority Data

Feb. 10, 1978 [DE] Fed. Rep. of Germany ..... 2805668

[51] Int. Cl.[2] ..... E05G 1/04; E05G 1/10

[52] U.S. Cl. ..... 109/40; 109/57

[58] Field of Search ..... 109/40, 39, 41, 43, 109/44, 49.5, 59 R, 55, 54, 53

[56] References Cited

U.S. PATENT DOCUMENTS

| | | | |
|---|---|---|---|
| 253,129 | 1/1882 | Teese | 109/54 |
| 1,184,094 | 5/1916 | Harrington | 109/57 |
| 2,879,725 | 3/1959 | Zuver | 109/59 |
| 3,250,100 | 5/1966 | Cornaro | 109/59 |

*Primary Examiner*—Reinaldo P. Machado

*Attorney, Agent, or Firm*—Haseltine, Lake & Waters

[57] ABSTRACT

A safe having an armor plated housing and a armor plated door is provided with an automatic locking system for the door. Within the door an electric gear motor is disposed operating when energized the locking system. The electric motor is controlled by a timer switch which in turn is adjusted by a program control of a data storage system such that the door can be opened only during the service hours of the user.

The safe is provided with an inner door and in the chamber between the outer door and the inner door a key depot is arranged receiving at least keys for the inner door. The key depot has mechanical and electrical detecting devices checking the inserted keys.

10 Claims, 4 Drawing Figures

ARMOR PLATED SAFE

This invention refers to a safe comprising an armor plated housing, a hinged armor plate door for closing said housing and a locking mechanism arranged within said door.

Safe structures of this kind are provided with an operating mechanism at the outside of the door for example in form of number combination lock in order to control the tumbler of the locking mechanism and a hand operated wheel for moving the bolt of the locking mechanism. Also known are safe doors locked by keys which have been provided with code means operating the tumblers and driving means operating the locking mechanism.

Those persons who have to keep the keys or know the opening combination of the safe are exposed to the danger of blackmail especially before or after the time of service. The proposal of providing a key depot for the safe keys could not eliminate said problem because also here persons must keep a key or know a number combination.

Therefore one object of the invention is to provide a safe which has no operating mechanism at its outside but nevertheless can be opened only during predetermined periods of time but is securely closed before or after these periods of time. A further object of this invention is to provide a combination of a safe and a key depot whereby the access to the latter is only possible within predetermined periods of time and the access to the inner chamber of the safe is only possible after withdrawing the keys out of the key depot and unlocking an inner door of the safe. A further object of the invention is to provide a simple lock mechanism which can be produced with low costs and provides a secure operation. Last not least it is an object of this invention to provide an electronic alarm circuit for a safe which gives an alarm signal if the safe door or safe doors are not locked and/or if the proper keys are not placed into the key depot after predetermined locking periods have begun.

The invention refers to a safe comprising an armor plated housing, a hinged armor plate door for closing said housing, a locking mechanism arranged within said door and electric driving means for operating the locking mechanism, said driving means being arranged within said door, a program controlled time switch arrangement within said housing, an adjustment device for programming said time switch; said program controlled time switch and said adjustment device being not accessible from outside of the safe, an electric connection between said time switch and said driving means and a power supply electrically connected with said time switch and said driving means.

Because the electric driving means are arranged within the door of the safe only electric mains or leads connect the driving motor within the door with the time switch and the power supply arranged within the safe chamber. According to a further object of the invention said door comprises an arc shaped shield arranged behind said armor plate adjacent said hinge joint of the door, said arc shaped shield covering and protecting electric power lines and electric supply lines between said time switch and said driving mechanism. Thereby the electric lines are securely protected against inadmissible manipulations.

The safe according to this invention is provided only with a handle at the outside of the door and there are no openings or movable parts enabling experts to inadmissibly open the door. During the service hours the armor plated outer door of the safe can be opened by everybody. After and before that predetermined period of time the safe remains closed and by nobody can be opened. The lock mechanism is locked and unlocked automatically by means of the time switch, the program control of which can be adjusted for many months in advance.

An important feature of the invention consists in that said housing comprises an inner door behind said armor plate door, said inner door being accessible after opening of the armor plate door and being provided with a key-operated locking mechanism. In this connection it is advantageous according to a special embodiment of the invention that at least one key depot appartment is provided within said housing, that means between the outer door and the inner door. This key depot appartment comprises the combination of a mechanical and an electrical or electronical detecting device for each key.

These and further features and advantages of the invention will be explained in the following detailed description and the drawings in which FIG. 1 shows a partly broken plan view of an embodiment of a safe;

Figure 1:
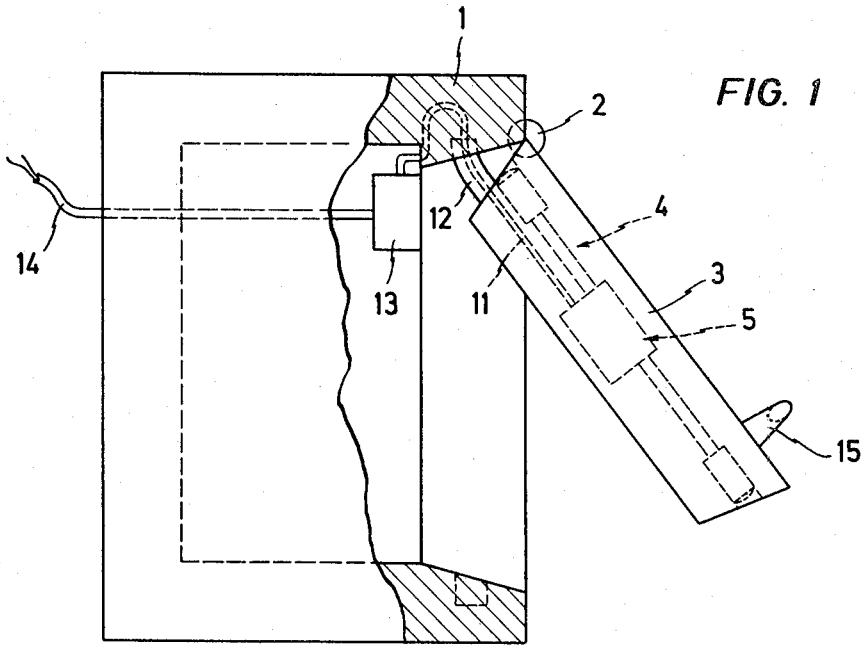

The safe according to FIG. 1 comprises a housing 1 at which by means of hinges 2 a door 3 is movably connected. Within the door a locking mechanism 4 is arranged operatively connected with a driving motor 5 which is an electric gear motor which is fastened at the door inside wall at the door inner surface facing the outer wall. According to FIG. 2 a gear wheel is fastened at the motor shaft. A pair of racks engage the gear wheel at opposite sides.

The racks are connected with bolt supports 6, 7 respectively. The bolt supports are provided with a pair of locking bolts respectively which are movably guided in holes of the opposite front side walls of the door respectively. The locking bolts in the locking position of the door extend into corresponding bores provided within the door frame of the safe shown in dotted lines in FIG. 1. If the gear motor 5 is actuated the racks are moved in opposite directions and the locking bolts are withdrawn from the door frame holes so that the door 3 can be opened by means of a handle 15 fastened at the outside wall of the door.

Figure 3:
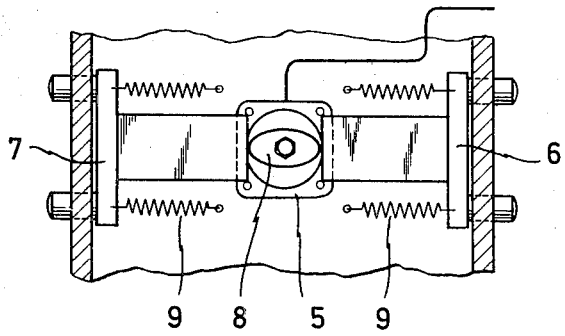
FIG. 3 shows a sectional view of a part of another embodiment of the locking mechanism within the door.

Another embodiment of the driving device for operating the locking mechanism is shown in FIG. 3. The motor shaft of the gear motor 5 is provided with a cam 8 the projecting parts of which shift the bolt supports outwards into the locking position of the locking mechanism against the action of return springs 9. If the motor is energized the cam is rotated by 90 degrees into a vertical position (FIG. 3) and the bolt supports 6, 7 are moved inwardly by means of the return springs 9 in order to unlock the door.

Figure 2:
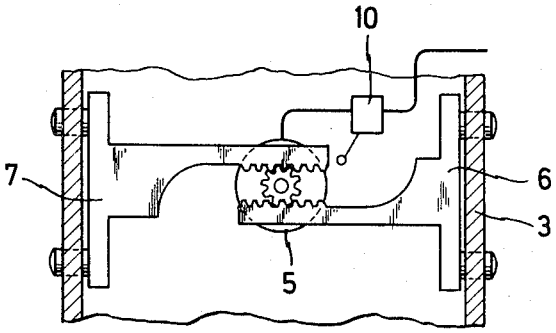
FIG. 2 shows a sectional view of a part of the safe door.

The electric gear motor 5 is a reversible motor and the respective end positions of the bolt supports 6, 7 are defined by micro-switches operated by the bolt supports or by an arm on the motor gear shaft. These micro-switches switch off the motor 5 respectively in each of its end positions within the operation cycle. FIG. 2 shows a micro-switch 10 of this kind which is operated by one of the bolt supports 6, 7 in the end position thereof.

The electric control lines and power lines 11 of the driving motor 5 extend within the door inner chamber behind of the armor plated door outer wall. The lines 11 run through an arcshaped shield structure protected by the wall of the housing 1 and the door outer wall. The lines 11 are connected with an electric time switch 13 provided within the safe housing. The time switch 13 comprises a memory or storage unit in which a one year program or a month program or a week program is stored which controls the moment of energizing the motor for locking the door at the end of the service period of the user and for unlocking the door at the beginning of that period. In FIG. 1 a power supply line 14 is shown passing through the back wall of the safe. This power supply line connects the time switch 13 with a power source. In an alternative embodiment the power source is a battery or accumulator arranged within the safe housing.

Figure 4:
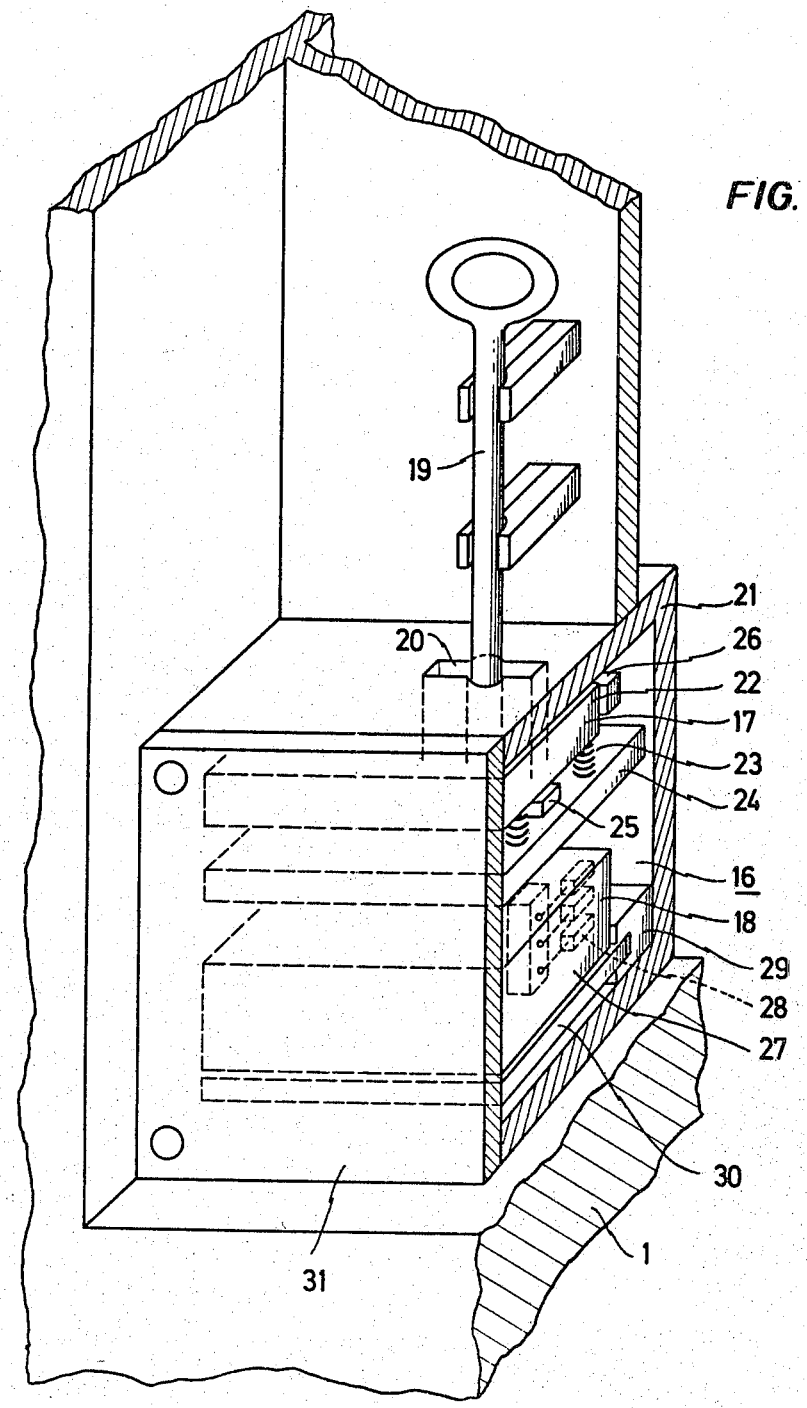
FIG. 4 shows a perspective sectional view of a part of a key depot appartment of a safe in which the detecting means are shown.

The safe of the aforementioned construction can be provided with a key depot appartment as shown diagrammatically in FIG. 4. This key depot is provided to keep besides other keys those keys by which an inner door can be opened which allows access to the safety chamber of the safe. The key depot appartment is arranged in a chamber between the outer armor plated door and that inner door. Special persons have these keys for the inner door about one during the service period. The keys are deposited in the key depot appartment at the end of the service time. Then the outer safe door 5 is closed by hand and will be locked automatically.

A detecting means 16 shown diagrammatically in FIG. 4 comprises a mechanical detecting device 17 and an electric detecting device 18 for mechanically and electrically detecting the key code elements of a key 19 respectively. This key is inserted through a recess 20 in form of a key-hole into a housing 21 of the detecting arrangement 16, whereby the front end of the key provided with code elements passes through a detecting screen plate 22 having a recess of a corresponding shape. The detecting screen plate formed as a drawer is shifted into the housing 21 and supported on an intermediate bottom 24 by means of springs 23. Detector switches or microswitches 25 and 26 are provided which are connected with an alarm circuit of the safe or with a signal circuit producing a signal dependent on a change in the position of the detecting screen plate 22 or a movement thereof. Either the detecting switch 26 responds if the detecting screen plate unauthorizedly is exchanged or detecting switch 25 responds if a non-proper key contacts the detecting screen in the region of the recess thereof so that the screen is forced downwardly in the direction of the intermediate bottom 24.

When the key 19 is moved downwards the front end of which provided with said code elements arrives at a detecting block 27 of the electric detecting device 18. The block 27 comprises a plurality of electrical detectors diagrammatically shown at 28. These detectors scan or detect the key code elements one after another. The block 27 is connected with a circuit support plate 30 via a plug-in connection 29. The circuit support plate 30 similar as the screen plate 22 can be shifted into the housing 21 of the depot appartment like a drawer and comprises a circuit corresponding to the respective key code to be checked.

Connecting lines between the detecting switches 25 and 26 and the plug-in connection 29 on the one hand and an alarm or signal circuit of the safe on the other hand have been omitted for simplification of the drawings.

The drawer-like inserts of the housing 21 allow a simple exchange of the detecting arrangement if other keys are to be deposited. Instead of the simplified arrangement of FIG. 4 in a practical embodiment a plurality of units as shown are used in order to control the deposit of a plurality of keys.

The drawer-like inserts of the housing 21 are positioned behind an armor plate 31 which for unauthorized persons is undetachably fastened at the housing 21.

What I claim is:

1. A safe comprising an armor plated housing, a hinged armor plate door for closing said housing, a locking mechanism arranged within said door and electric driving means for operating the locking mechanism, said driving means being arranged within said door, a program controlled time switch arrangement within said housing, an adjustment device for programming said time switch; said program controlled time switch and said adjustment device being not accessible from outside of the safe, an electric connection between said time switch and said driving means and a power supply electrically connected with said time switch and said driving means.

2. A safe as claimed in claim 1, wherein said door comprises an arc shaped shield arranged behind said armor plate adjacent said hinge joint of the door, said arc shaped shield covering and protecting electric power lines and electric supply lines between said time switch and said driving mechanism.

3. A safe as claimed in claim 1 or 2, wherein said driving mechanism comprises a reversible electric driving motor operated by end switches switching off an reversing said driving motor.

4. A safe as claimed in claim 3, wherein said locking mechanism is operatively connected with a rack arrangement drivingly connected with a gear wheel fastened at a shaft of the driving motor.

5. A safe as claimed in claim 3, wherein said driving motor is drivingly connected with a cam operating said locking mechanism against the force of readjusting springs.

6. A safe as claimed in claim 1, wherein said housing comprises an inner door behind said armor plate door, said inner door being accessible after opening of the armor plate door and being provided with a key-operated locking mechanism.

7. A safe as claimed in claim 1 or 6, wherein at least one key depot appartment is provided within said housing.

8. A safe as claimed in claim 7, wherein said key depot appartment comprises detecting means for each key, the detecting means being composed by a mechanical detecting device and an electric or electronic detecting device, at least the electric or electronical detecting device comprising a plurality of detectors connected with an alarm circuit of the safe.

9. A safe as claimed in claim 8, wherein the mechanical detecting device comprises a drawer within said key depot appartment, the drawer being arranged behind an armor plate and being provided with a detecting screen having a key-hole, the detecting screen being movably supported at said drawer, the position or movement of the screen being detected by detecting switches.

10. A safe as claimed in claim 8 or 9, wherein the electric or electronic detecting device comprises a detecting block provided with a plurality of detecting elements, the detecting block being connected with a drawer by means of a plug-in connection the drawer consisting of a circuit carrying plate, the circuit arrangement of which corresponding to the respective key code.

* * * * *